US005597089A

United States Patent [19]

Smith

[11] Patent Number: 5,597,089

[45] Date of Patent: Jan. 28, 1997

[54] BEVERAGE CONTAINER

[76] Inventor: Willem J. Smith, P.O. Box 877, Parow, 7500, South Africa

[21] Appl. No.: 300,534

[22] Filed: Sep. 6, 1994

[51] Int. Cl.[6] ..... B65D 5/74

[52] U.S. Cl. ..... 220/710; 215/389; 215/256; 215/901; 220/207; 220/277

[58] Field of Search ..... 220/705, 710, 220/267, 277; 215/389, 254, 256, 901

[56] References Cited

U.S. PATENT DOCUMENTS

| | | | |
|---|---|---|---|
| 4,251,019 | 2/1981 | Cone | 220/705 |
| 5,353,983 | 10/1994 | Miller | 220/705 |
| 5,431,297 | 7/1995 | Rosello | 220/705 |

FOREIGN PATENT DOCUMENTS 9170211 8/1992 Australia .

*Primary Examiner*—Joseph M. Moy
*Attorney, Agent, or Firm*—Cushman Darby & Cushman IP Group Pillsbury Madison & Sutro LLP

[57] ABSTRACT

A beverage container 10 suitable for liquids includes a vessel 12 which defines a filling orifice proximate a first end thereof. A drinking straw 14 is integral with, and external of, the vessel 12 so that the straw 14 and the vessel 12 form a one-piece article, the straw 14 communicating with the interior of the vessel 12 proximate ends thereof remote from the filling orifice. A free end of the straw 14 is sealed by a rupturable membrane. A closure element 40 sealingly closes the filling orifice of the vessel 12. The closure element 40 includes a tamper indicating means. A closure cap 56 is formed integrally, as a one-piece article, with the tamper indicating means of the closure element 40. The closure cap 56 is mountable on said free end of the straw 14, after rupturing of the membrane, to close off said free end of the straw 14.

17 Claims, 3 Drawing Sheets

BEVERAGE CONTAINER

BACKGROUND OF THE INVENTION

THIS INVENTION relates to a beverage container. More particularly, the invention relates to a beverage container suitable for liquids such as milk, fruit juice, mineral water, or the like.

SUMMARY OF THE INVENTION

According to the invention, there is provided a beverage container of the type described, the container including a vessel which defines a filling orifice proximate a first end thereof;

a drinking straw integral with, and external of, the vessel, the drinking straw communicating with the interior of the vessel proximate an end thereof remote from the filling orifice, a free end of the straw being sealed by a rupturable membrane;

a closure element for sealingly closing the filling orifice of the vessel, the closure element including a tamper indicating means; and a closure cap formed integrally with the tamper indicating means of the closure element as a one-piece article, the closure cap being mountable on said free end of the straw, after rupturing of the membrane, to close off said free end of the straw.

The closure element may include a substantially planar crown portion with an outer skirt portion depending from the crown portion.

A neck of the vessel and an inner surface of the outer skirt portion may have complementary formations for retaining the closure element in position on the vessel. The complementary formations may comprise a plurality of spaced circumferential ribs on the neck portion of the vessel and complementary circumferential grooves defined in the inner surface of the outer skirt portion of the closure element.

The tamper indicating means may comprise a strip-like part of the skirt portion which is demarcated from the remainder of the skirt portion by a region of reduced thickness in said outer skirt portion.

The closure element may include an inner skirt portion depending from the crown portion. The inner skirt portion may be shaped and dimensioned to seat sealingly in the filling orifice thereby to effect sealing of the filling orifice.

The closure cap of the beverage container may include an operatively top portion with a tubular portion depending therefrom. The tubular portion may be formed integrally, as a one-piece article, with an extension of the strip-like part of the outer skirt portion of the closure element. The tubular portion of the closure cap may be shaped and dimensioned to fit snugly about the free end of the straw to effect sealing closure of the straw after rupturing of the membrane.

The closure cap may include a rupturing means for rupturing the membrane of the straw. The rupturing means may comprise a spike projecting from the top portion of the closure cap.

The vessel may include a base portion with a cylindrical body extending from the base portion. The cylindrical body may have a recessed region defined therein within which the straw is accommodated. The recessed region may be defined by a substantially flat side wall arranged inwardly of the base portion such that the straw extends upwardly from the base portion inwardly of a periphery of the base portion.

In a preferred embodiment of the invention, the body is of a polygonal transverse cross-section. Then, the flat side wall may be located at a corner of adjacent sides of the body. The body may be of rectangular or square transverse cross-section.

According to another aspect of the invention, there is provided a beverage container which includes a vessel having a sealable orifice defined therein; and a drinking straw arranged integrally with, and externally of, the vessel, the vessel having a base portion and a cylindrical body extending upwardly from the base portion, the body being defined partly by a substantially flat side wall, arranged inwardly of the base portion, and a part-polygonal cylindrical portion.

As indicated above, the vessel and the straw are formed integrally as a one-piece element. Preferably, the vessel and the straw are formed by blow moulding. Thus, the beverage container may be of a synthetic plastics material. For example, the beverage container may be of a polyolefin material such as high density polyethylene (HDPE).

The invention is now described by way of example, with reference to the accompanying diagrammatic drawings.

DETAILED DESCRIPTION OF DRAWINGS

Figure 4:
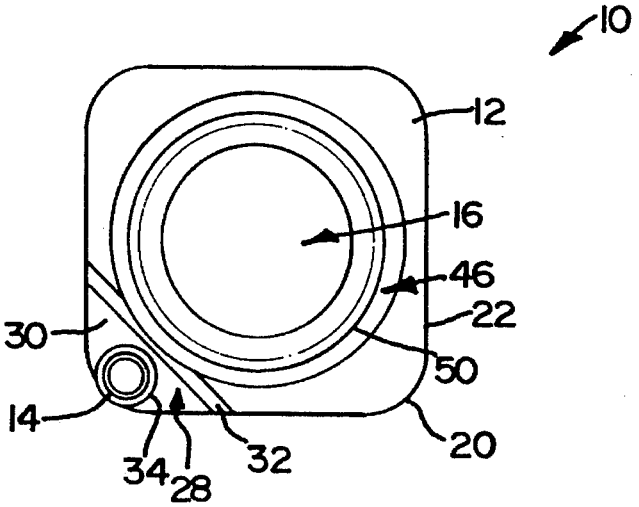
FIG. 4 shows a plan view of the container with the closure element omitted.

Referring to the drawings, a beverage container, in accordance with the invention, is illustrated and is designated generally by the reference numeral 10. The beverage container 10 comprises a vessel 12 having a drinking straw 14 formed integrally therewith. The vessel 12 defines a filling orifice 16 (FIG. 4) at a first end thereof. The drinking straw 14 communicates with the interior of the vessel 12 proximate an end 18 of the vessel 12 remote from the filling orifice 16. The end 18 is defined by a base portion 20 of the vessel 12.

As illustrated, the base portion 20 is substantially square in outline and the vessel 12 includes a part-polygonal cylindrical portion 22 extending from the base portion 20. The cylindrical portion 22 is of substantially square transverse cross-section. A part of the cylindrical portion 22 is truncated by a substantially flat side wall 24 arranged between two adjacent sides of the cylindrical portion 22. The flat side wall 24 defines a recessed region 26 in which the drinking straw 14 is accommodated. Hence, it will be appreciated that the straw 14 projects upwardly from the base portion 20 at a stepped junction 28 between the base portion 20 and the cylindrical portion 22 and is accommodated in the recessed region 26 inwardly of a periphery of the base portion 20.

The stepped junction 28 defines a first step 30 from the which the drinking straw 14 projects and a second step 32 to accommodate a concertina-like region 34 of the drinking straw 14.

A free end 14.1 of the drinking straw is closed off by a rupturable membrane 36.

Figure 5:
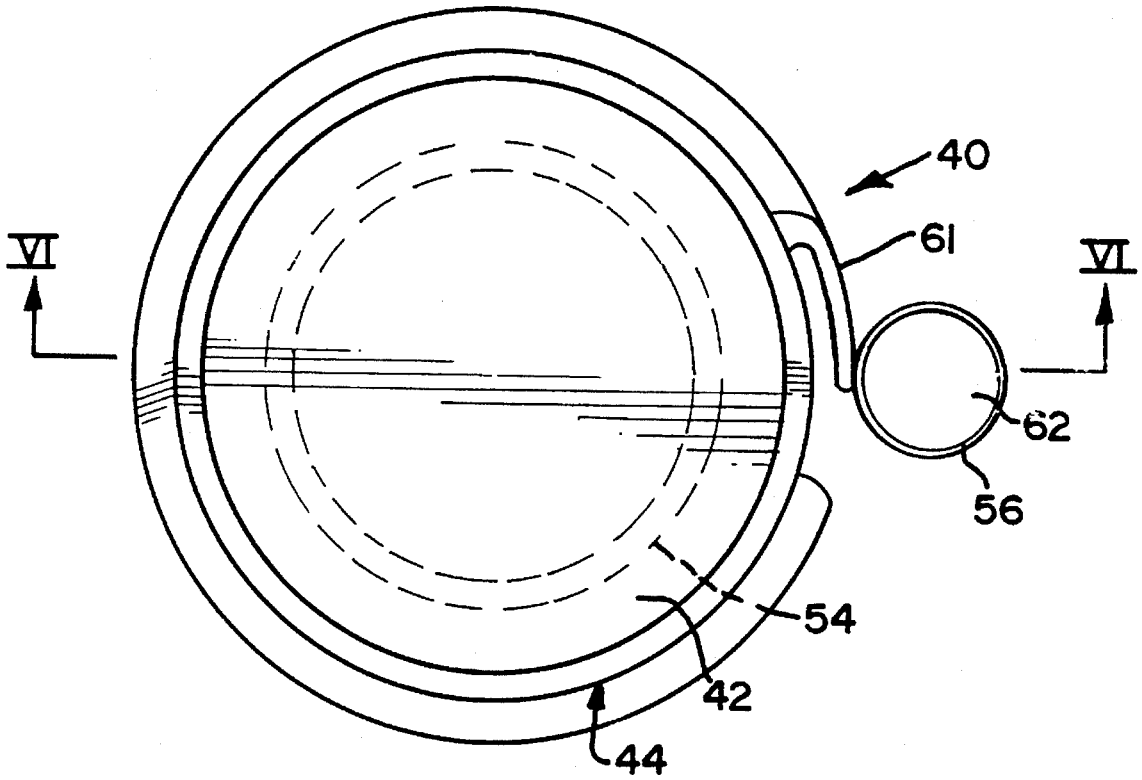
FIG. 5 shows a plan view of a closure element of the container.
Figure 6:
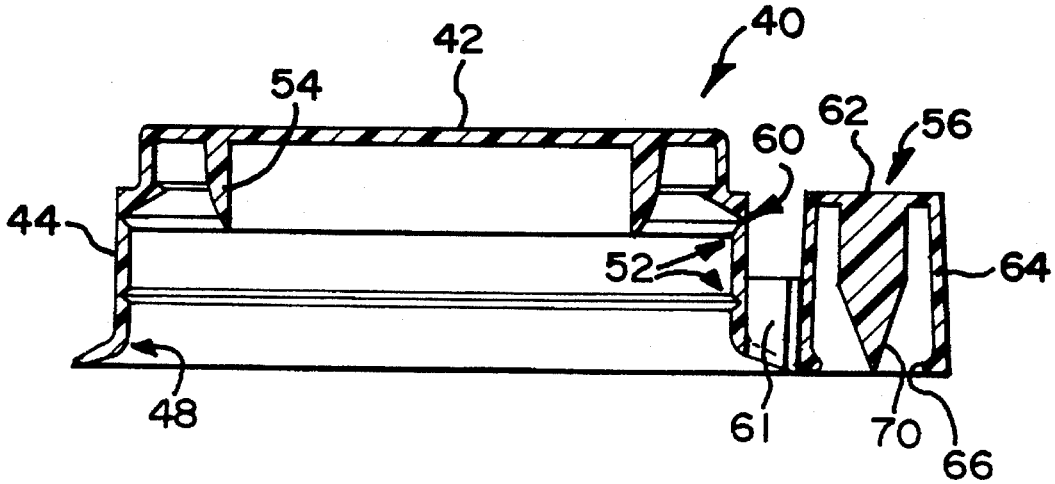
FIG. 6 shows a sectional side view of the closure element taken along line VI—VI in FIG. 5.

The filling orifice 16 of the vessel 12 is closed off by a closure element 40. The closure element 40 is illustrated in greater detail in FIGS. 5 and 6 of the drawings.

Figure 3:
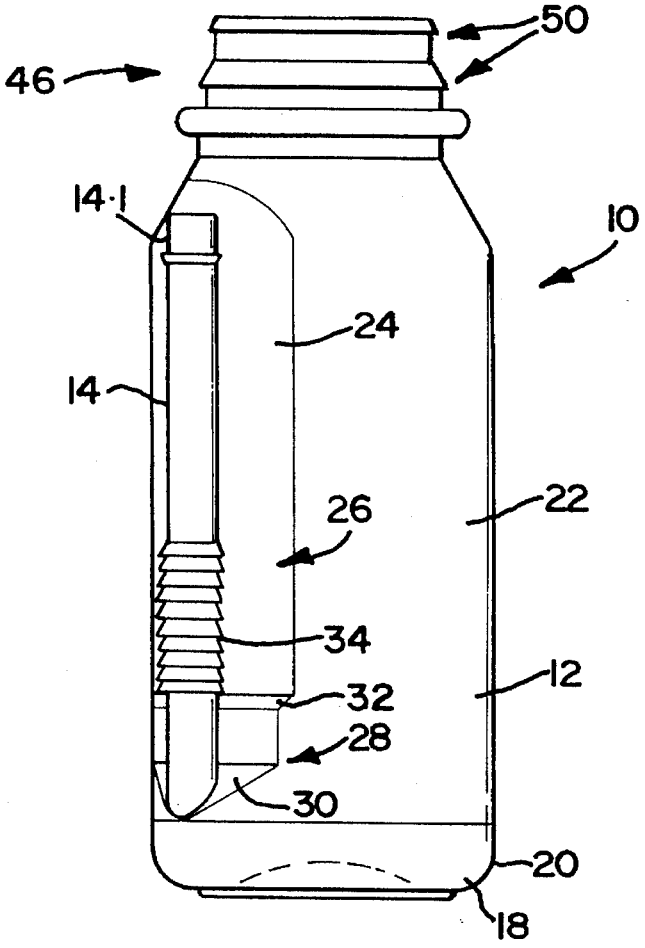
FIG. 3 shows a side view of the beverage container with a closure element thereof omitted.

The closure element 40 comprises a substantially planar crown portion 42 with an outer skirt portion 44 depending therefrom. A neck 46 (FIG. 3) of the vessel 12 and an inner surface 48 (FIG. 6) of the outer skirt portion 44 of the closure element 40 have complementary formations 50 and 52, respectively, for retaining the closure element 40 on the neck 46 of the vessel 12, in use. The formations 50 are in the form of a pair of circumferential outwardly extending ribs arranged about the neck 46 of the vessel 12. The formations 52 are in the form of spaced, circumferential grooves defined in the inner surface 48 of the outer skirt portion 44 in which the ribs are received, in use.

The closure element 40 includes an inner skirt portion 54 depending downwardly from the crown portion 42. The inner skirt portion 54 is a snug fit in the filling orifice 16 to close the filling orifice 16 sealingly.

A closure cap 56 is formed integrally with the closure element 40. The closure element 40 is a tamper-indicating or pilfer-indicating type element. Thus, the closure element 40 includes a strip-like part 58 which is formed as a part of the outer skirt portion 44. The strip-like part 58 is demarcated relative to the remainder of the outer skirt portion via a region 60 (FIG. 6) of reduced thickness in the outer skirt portion 44. This region 10 is defined by the upper groove 52. The closure cap 56 is arranged at the free end of the strip-like part 58 and is mounted on a tag-like extension 61 of the part 58.

Figure 1:
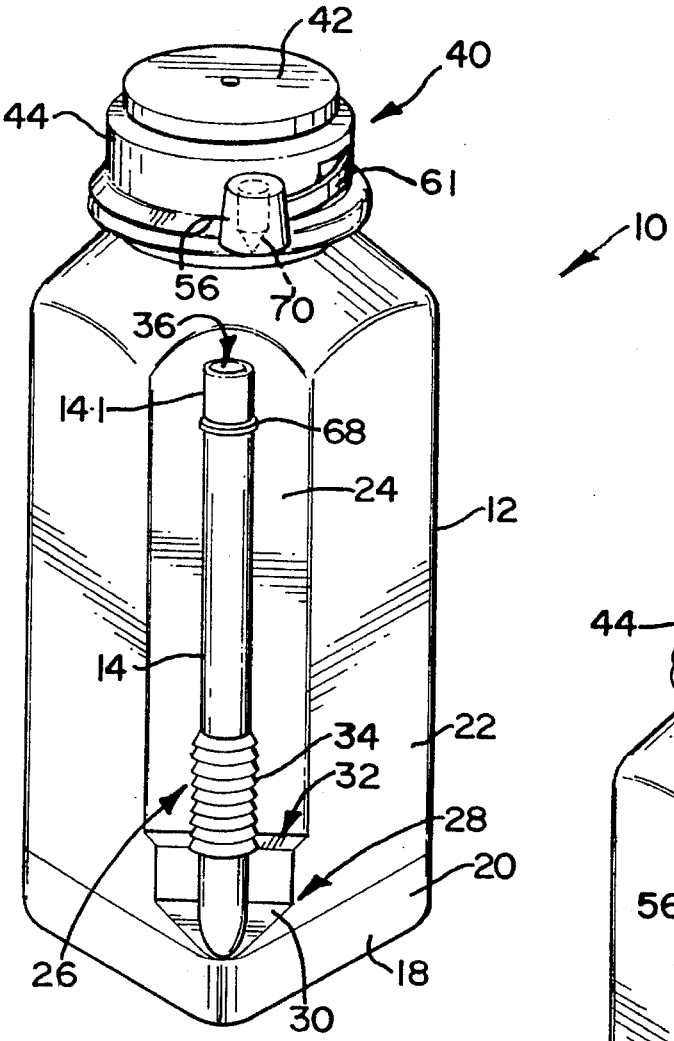
FIG. 1 shows a three-dimensional view of a beverage container, in accordance with the invention, prior to use.

The closure cap 56 also has a substantially planar top portion 62 with a tubular portion 64 depending therefrom. A free end of the tubular portion 64 has an inwardly directed lip 66 which fits over a rib 68 (FIG. 1) on the straw 14 when the closure cap 56 is mounted on the straw 14. The closure cap 56 includes a rupturing means in the form of a spike 70 which depends from the top portion 62 of the closure cap 56.

Figure 2:
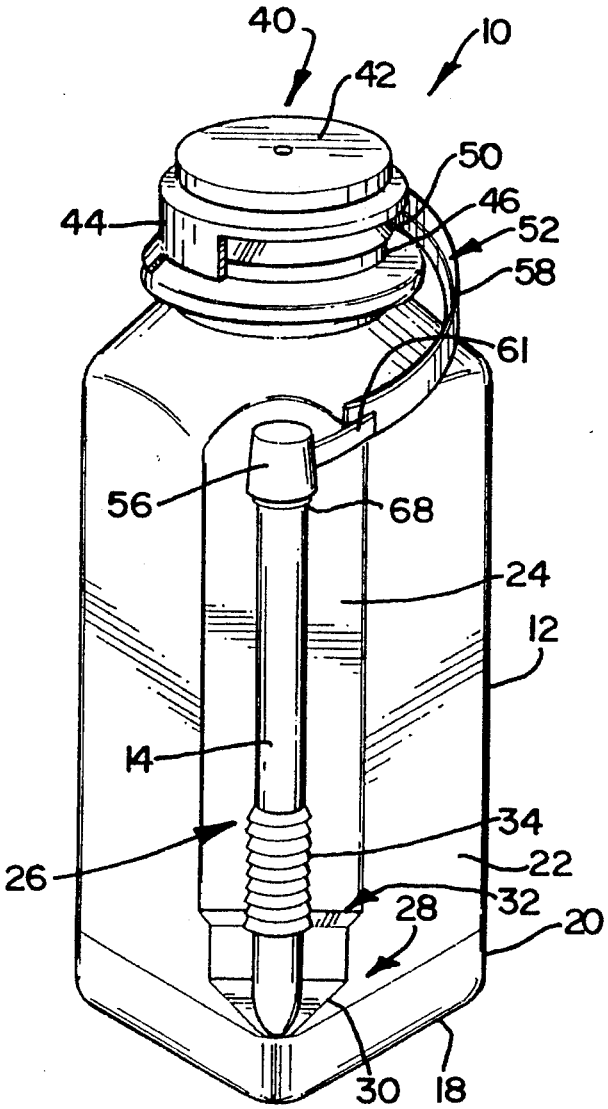
FIG. 2 shows a three-dimensional view of the container in FIG. 1 after use.

In use, the part 58 is partially separated (as shown in FIG. 2) from the remainder of the outer skirt portion 44 by tearing along the region 60 of reduced thickness while still remaining attached to the remainder of the skirt portion 44. The spike 70 of the closure cap 56 is urged through the membrane 36 at the free end 14.1 of the straw 14 to rupture the membrane 36 to enable the contents of the beverage container 12 to be drunk through the straw 14.

To aid in drinking from the container 10, the straw 14 has the flexible concertina-like region 34. Thus, the straw 14 can be bent away from the vessel 12 to enable a person to place his or her mouth over the free end 14.1 of the straw 14 unencumbered by the vessel 12.

It is a particular advantage of the invention that the closure cap 56 for the straw 14 is formed integrally with the closure element 40, thereby reducing the risk of the closure cap 56 becoming a "choke hazard". Also, the use of a pilfer-indicating type closure element 40 will provide a ready indication of tampering with the container 10 or its contents. Also, by having the vessel 12 of a substantially square transverse cross-section, this assists in the packing of the containers 12.

I claim:

1. A beverage container suitable for liquids, the container including a vessel which defines a filling orifice proximate a first end thereof;

a drinking straw integral with, and external of, the vessel, so that the straw and the vessel form a one-piece unit, the straw communicating with the interior of the vessel proximate an end thereof remote from the filling orifice, a free end of the straw being sealed by a rupturable membrane;

a closure element for sealingly closing the filling orifice of the vessel, the closure element including a tamper indicating means; and a closure cap formed integrally with the tamper indicating means of the closure element as a one-piece article, the closure cap being mountable on said free end of the straw, after rupturing of the membrane, to close off said free end of the straw.

2. The container as claimed in claim 1 in which the closure element includes a substantially planar crown portion and an outer skirt portion depending from the crown portion.

3. The container as claimed in claim 2 in which each of a neck of the vessel and an inner surface of the outer skirt portion has a complementary formation for retaining the closure element in position on the vessel.

4. The container as claimed in claim 3 in which the complementary formations comprise a plurality of spaced circumferential ribs on the neck portion of the vessel and complementary circumferential grooves defined in the inner surface of the outer skirt portion of the closure element.

5. The container as claimed in claim 2 in which the tamper indicating means comprises a strip-like part of the skirt portion which is demarcated from the remainder of the skirt portion by a region of reduced thickness in said outer skirt portion.

6. The container as claimed in claim 2 in which the closure element includes an inner skirt portion depending from the crown portion, the inner skirt portion being shaped and dimensioned to seat sealingly in the filling orifice to facilitate sealing of the filling orifice.

7. The container as claimed in claim 5 in which the closure cap includes an operatively top portion and a tubular portion depending from the top portion.

8. The container as claimed in claim 7 in which the tubular portion is formed integrally, as a one-piece article, with an extension of the strip-like part of the outer skirt portion of the closure element.

9. The container as claimed in claim 7 in which the tubular portion of the closure cap is shaped and dimensioned to fit snugly about the free end of the straw to effect sealing closure of the straw after rupturing of the membrane.

10. The container as claimed in any one of claims 7 in which the closure cap includes a rupturing means for rupturing the membrane of the straw.

11. The container as claimed in claim 10 in which the rupturing means comprises a spike projecting from the top portion of the closure cap.

12. The container as claimed in claim 10 in which the vessel includes a base portion with a cylindrical body extending from the base portion.

13. The container as claimed in claim 12 in which the cylindrical body has a recessed region defined therein within which the straw is accommodated such that the straw extends upwardly from the base portion inwardly of a periphery of the base portion.

14. The container as claimed in claim 13 in which the recessed region is defined by a substantially flat side wall arranged inwardly of the base portion.

15. The container as claimed in claim 14 in which the body is of a polygonal transverse cross-section, the side wall portion being located at a corner adjacent sides of the base portion.

16. The container as claimed in claim 15 in which the body is of rectangular cross-section.

17. The container as claimed in claim 16 in which the body is of square cross-section.

* * * * *